US007237525B1

(12) United States Patent
Olszewski et al.

(10) Patent No.: US 7,237,525 B1
(45) Date of Patent: Jul. 3, 2007

(54) ENGINE CAST COMPONENT HAVING WITNESS MARKS AND METHOD OF MACHINING SAME

(75) Inventors: Robert Z. Olszewski, Glen Ellyn, IL (US); W. Bryan Snyder, Westland, MI (US); Martin R. Zielke, Lockport, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/463,208

(22) Filed: Aug. 8, 2006

(51) Int. Cl.
*F02B 75/22* (2006.01)
*F02F 1/10* (2006.01)

(52) U.S. Cl. ..... 123/195 R; 123/1 R

(58) Field of Classification Search ..... 123/1 R, 123/195 R
See application file for complete search history.

(56) References Cited

U.S. PATENT DOCUMENTS 7,021,263 B1 * 4/2006 Agnew et al. ..... 123/184.34

* cited by examiner

*Primary Examiner*—Noah P. Kamen
(74) *Attorney, Agent, or Firm*—Elias P. Soupos; Susan L. Lukasik; Jeffrey P. Calfa

(57) ABSTRACT

A component (100) for an internal combustion engine includes a plurality of as-cast features (e.g. 116) formed thereon, and a plurality of machined features (e.g. 120). The component (100) also includes at least one witness mark (128), the witness mark (128) including a cavity (202) surrounded by a first lateral surface (204), a first inclined surface (208), a second inclined surface (210), and a valley surface (212). The at least one witness mark (128) is formed during a casting operation, and is used to locate the component (100) on a fixture (300). The plurality of machined features (120) do not encroach onto an area of the at least one witness mark (128). The first inclined surface (208) and the second inclined surface (210) are at an angle (α) with respect to each other.

10 Claims, 4 Drawing Sheets

ENGINE CAST COMPONENT HAVING WITNESS MARKS AND METHOD OF MACHINING SAME

FIELD OF THE INVENTION

This invention relates to internal combustion engines, including but not limited to crankcase machining and datum features therefor.

BACKGROUND OF THE INVENTION

Internal combustion engines include crankcases having a plurality of cylinders. The cylinders contain pistons whose reciprocating motion due to combustion events may be transferred through a crankshaft to yield a torque output of the engine. Often, engine crankcases are made of cast metal, and include features that are either formed or machined therein subsequent to the casting thereof.

Known methods for machining crankcases include the casting of machining datums, or, cast features that are used to locate the casting onto a machining device. By proper placement and location of a casting onto a machining device, positional and tolerance dimensions may be accomplished in the creation of various machined features in a crankcase.

Typical machining datums are "nubs", or protrusions, that are cast into the metal of the crankcase and that fit into openings in a "table" of a machining device. These nubs typically serve no purpose other than to locate the crankcase, and are usually placed onto surfaces that will eventually be machined themselves thus obliterating the nubs. The reason for deletion of the nubs is primarily to reduce the weight of the finished and machined crankcase, and to also improve the shape, appearance, and fit of same in an engine.

One disadvantage of the existing machining datum configuration, or nubs, for cast metal crankcases is that their shape, typically a rectangular shape, does not allow for alignment of a casting for more than two degrees of freedom of motion. Moreover, existing datum configurations that are obliterated in the finished product do not allow for a dimensional check for the quality of each machining operation in the finished product.

Accordingly, there is a need for an improved machining datum design configuration that allows for location for more than two degrees of freedom of the casting for machining, and that allow for a dimensional check for the quality of each machining operation in the finished product.

SUMMARY OF THE INVENTION

A component for an internal combustion engine includes a plurality of as-cast features formed thereon, and a plurality of machined features. The component also includes at least one witness mark, the witness mark including a cavity surrounded by a first lateral surface, a first inclined surface, a second inclined surface, and a valley surface. The at least one witness mark is formed during a casting operation, and is used to locate the component on a fixture. The plurality of machined features do not encroach onto an area of the at least one witness mark. The first inclined surface and the second inclined surface are at an angle with respect to each other.

DESCRIPTION OF A PREFERRED EMBODIMENT

The following describes an apparatus for and method of creating datums, or machining marks, that allow for location for more than two degrees of freedom of the casting for machining, and that allow for a dimensional check for the quality of each machining operation in the finished product, in accordance with the invention. The datums described herein may also be referred to as "witness" marks, because they are not obliterated after the machining process on the crankcase is completed, and may serve as "witnesses" for early machining operations.

Figure 1:
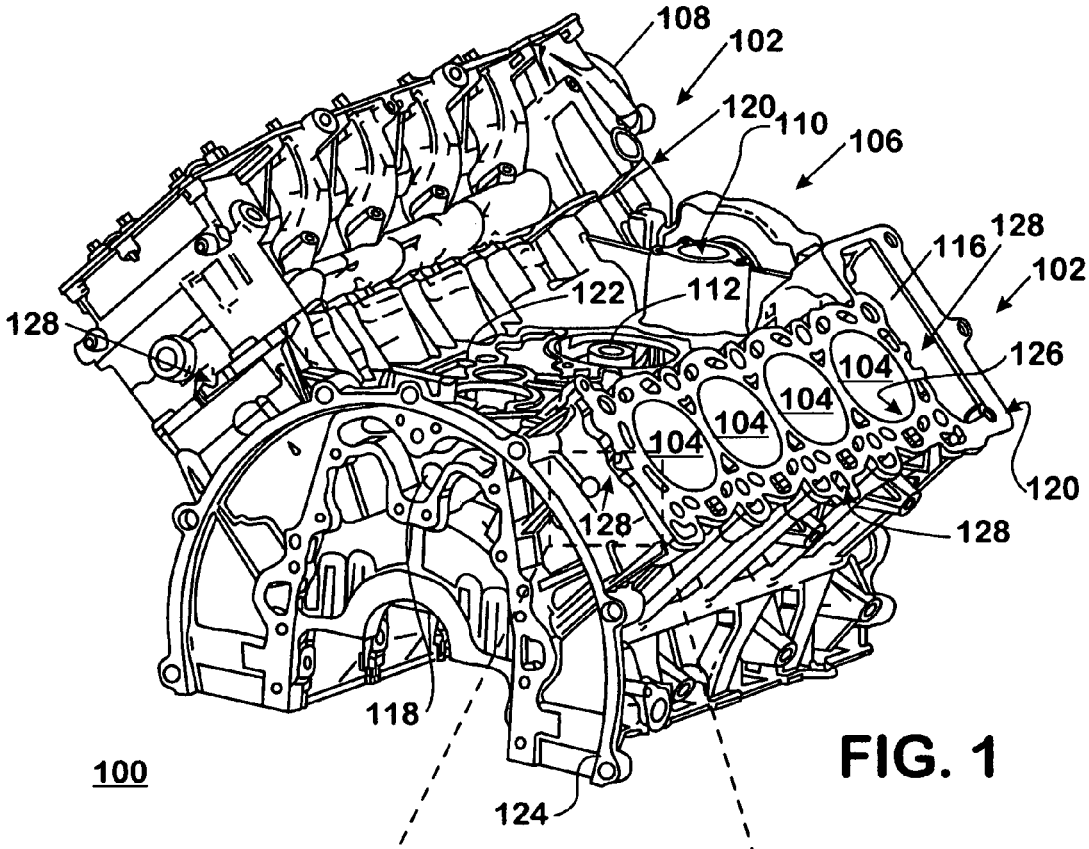
FIG. 1 is an outline view of an engine crankcase having witness mark machining datums in accordance with the invention.

An outline view of a crankcase 100 for an engine is shown in FIG. 1. The crankcase 100 shown is a crankcase for an eight (8) cylinder engine having a "V" configuration. Two banks 102 each having four (4) cylinders 104 are oppositely located on either side of the crankcase 100 along its entire length. The cylinder banks 102 are connected to a valley structure 106 occupying a central portion of the crankcase 100. A cylinder head 108 is shown attached to the crankcase 100 on one of the cylinder banks 102. The cylinder head 108 may include additional engine components (not shown) such as fuel injectors, intake and exhaust valves, over-head camshafts, and so forth. The crankcase 100 may also include a number of different integrated passages and/or cavities. For example, a coolant passage 110, a turbocharger oil supply passage 112, a timing chain cavity 116, and others, may be formed in the crankcase 100.

A central oil supply passage 118 may be drilled through an entire length of the valley structure 106 of the crankcase 100. An operation commonly referred to as "gun drilling" may be used to form the passage 188 by drilling a long opening through a metal body of the crankcase 100. The passage 118 may be used to transfer oil or another fluid from one end of the crankcase 100 to another. The oil in the passage 118 may be used for various purposes during operation of an engine, for example, for lubrication of various engine components, for actuation of fuel injectors, for lubrication and/or actuation of an overhead cam structure, and others. Typically, oil from the passage 118 may be distributed to other passages.

The crankcase 100 includes various other machined features. For example, a surface 120 on each of the top of the cylinder banks 102, commonly referred to as the "flame deck' may be the interface between the crankcase 100 and the cylinder head 108. A valley surface 122 disposed in the valley of the crankcase 100 may serve as an interface to other engine components, and a rear face 124 may serve as an interface for attachment on a rear housing (not shown) that may be used to mount a transmission (not shown). The cylinder bores 104 have lateral cylindrical surfaces 126 that are machined and are used to house pistons (not shown). All these surfaces, and others, that are formed on the crankcase 100 require precise positional and tolerance dimensions to be accomplished during various machining operations of the crankcase.

The crankcase 100 may advantageously include a plurality of witness marks 128 formed therein. Each of the witness marks 128 may be located in different areas of the crankcase 100 and serve as machining datums for machining operations that are performed after the crankcase 100 has been cast to create many of the features that are required in the crankcase 100 for interfaces to various components. Machining datums, as is known, are features that help locate reference points to guide machining cutters, drills, and so forth, that form various features on a casting.

A machining operation may use the witness marks 128 to establish a coordinate system of the crankcase 100, that may subsequently be used by a computer controlled machine or machines that will apply cutters, drills, end-mills, and so forth, to remove metal from a casting and form various features therein. This coordinate system that is created is advantageously based on locations of the crankcase 100 that are more important to the fit, form, and function of a the finished and machined crankcase.

Figure 2:
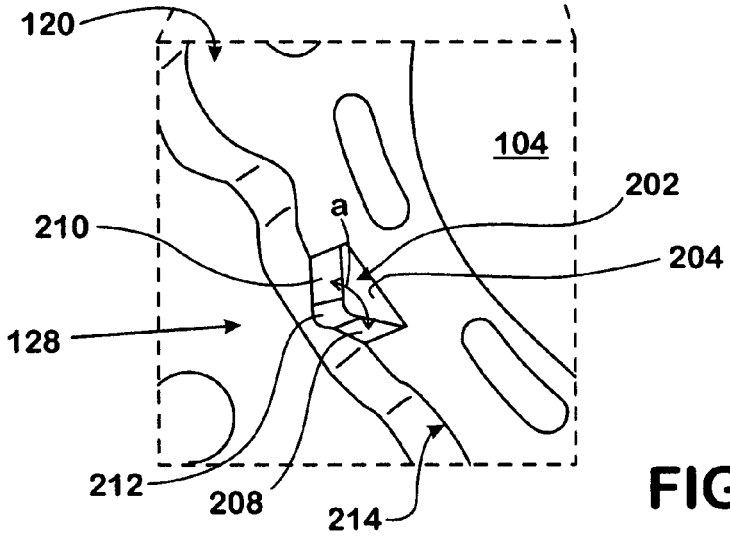
FIG. 2 is a detail view of a witness mark machining datum in accordance with the invention.

A close-up view of a witness mark 128, in cross section, is shown in FIG. 2. The witness mark 128 may be formed during a casting operation and may include a localized cavity or depression 202. The depression 202 may be surrounded by a first lateral surface 204, a first inclined surface 208, a second inclined surface 210, and a valley surface 212. The first inclined surface 208 may be oriented at an angle, $\alpha$, with respect to the second inclined surface 210 to facilitate multi-axial positioning, as described below. The witness mark 128 is disposed close to an edge 214 and, thus, does not have a second lateral surface (not shown) surrounding the cavity 202, but would have a second lateral surface had the witness mark had been disposed away from the edge 214. The second lateral surface would be across from the first lateral surface 204 around the cavity 202.

Figure 3:
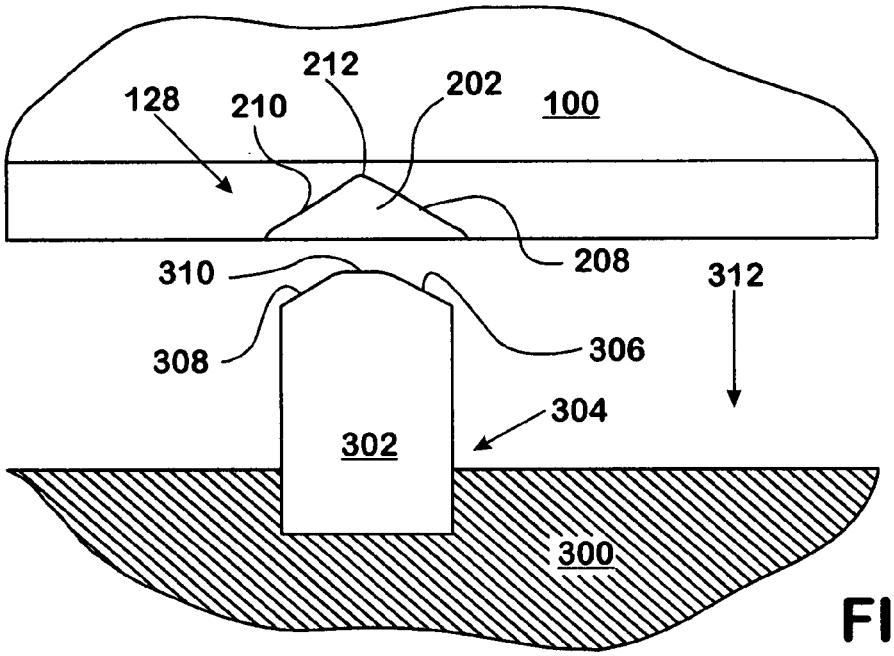
FIGS. 3 and 4 are different positions of a witness mark and a locator in accordance with the invention.

A detail view during a positioning operation of the crankcase 100 into a machine 300 is shown in FIG. 3. The machine 300, partially shown, may include a plurality of locators 302 (only one shown) that are arranged to correspond to one or more witness marks 128. Each locator 302 is arranged to fit within each witness mark 128, as shown, to help locate the crankcase 100 onto the machine 300. Each locator 302 includes a shank portion 304, a first beveled surface 306, a second beveled surface 308, and a tip portion 310 disposed at a distal end thereof. The crankcase 100 may move during this operation along a direction 312 until the witness mark 128 engages the locator 302.

Figure 4:
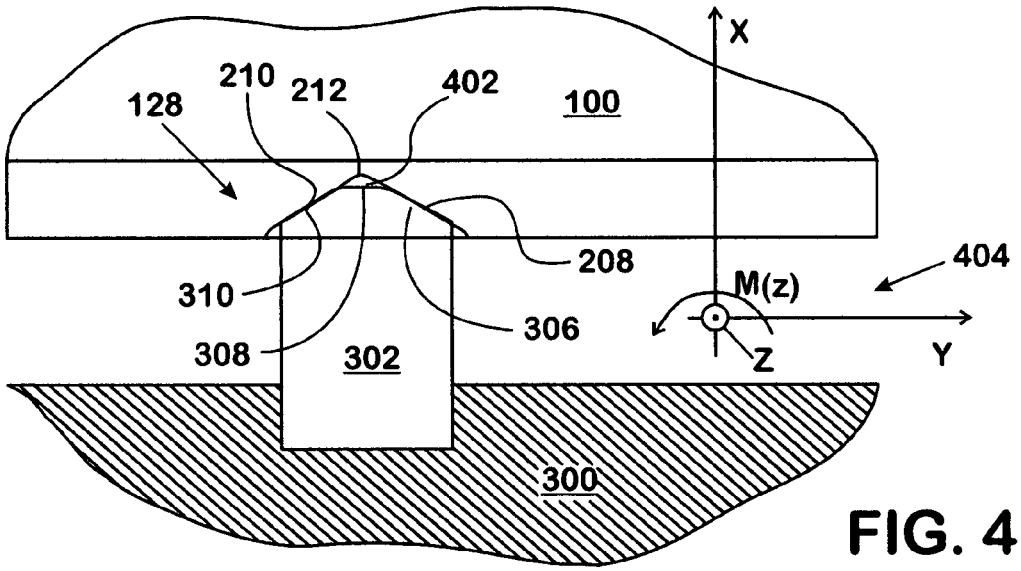

A detail view of the locator 302 engaged with the witness mark 128 is shown in FIG. 4. While the locator 302 is engaged with the witness mark 128, the first beveled surface 306 is planarly aligned and touching the first inclined surface 208, the second beveled surface 308 is planarly aligned with and touching the second inclined surface 210, and the tip 310 advantageously may not touch the valley surface 212, thus forming a gap 402 therebetween.

Each connection between a witness mark 128 and a locator 302 is advantageously capable of locating the crankcase 100 to the machine 300 with respect to three degrees of freedom. A coordinate system 404 may be defined having an axis, X, defined to measure the distance between the crankcase 100 and the machine 300, a second axis, Y, to measure the relative positional alignment between the crankcase 100 and the machine 300, and a "moment," M(z), to measure the relative rotation of the crankcase 100 to the machine 300 about an axis, Z, that is perpendicular to each of the axes X and Y. Engagement of the locator 302 with the witness mark 128 is capable of restricting and defining the position of the crankcase 100 on the machine 300 with respect to axial motion along X and Y, and rotation along M(z).

Restriction of motion along the X and Y axes, and rotation about M(z), is advantageously accomplished by a resistance to motion and rotation between the beveled surfaces 306 and 310 and the inclined surfaces 208 and 210 that are at the angle $\alpha$ with respect to each other and touching. The angle $\alpha$ may be selected to be any acute angle, and may advantageously be selected to be an included angle of about 90 degrees when constrain according to a perpendicular coordinate system is desired. By use of at least three (3) witness marks that may be oriented at 90 degrees to each other, one can advantageously fully constrain and locate the crankcase 100 to the machine 300.

Figure 5:
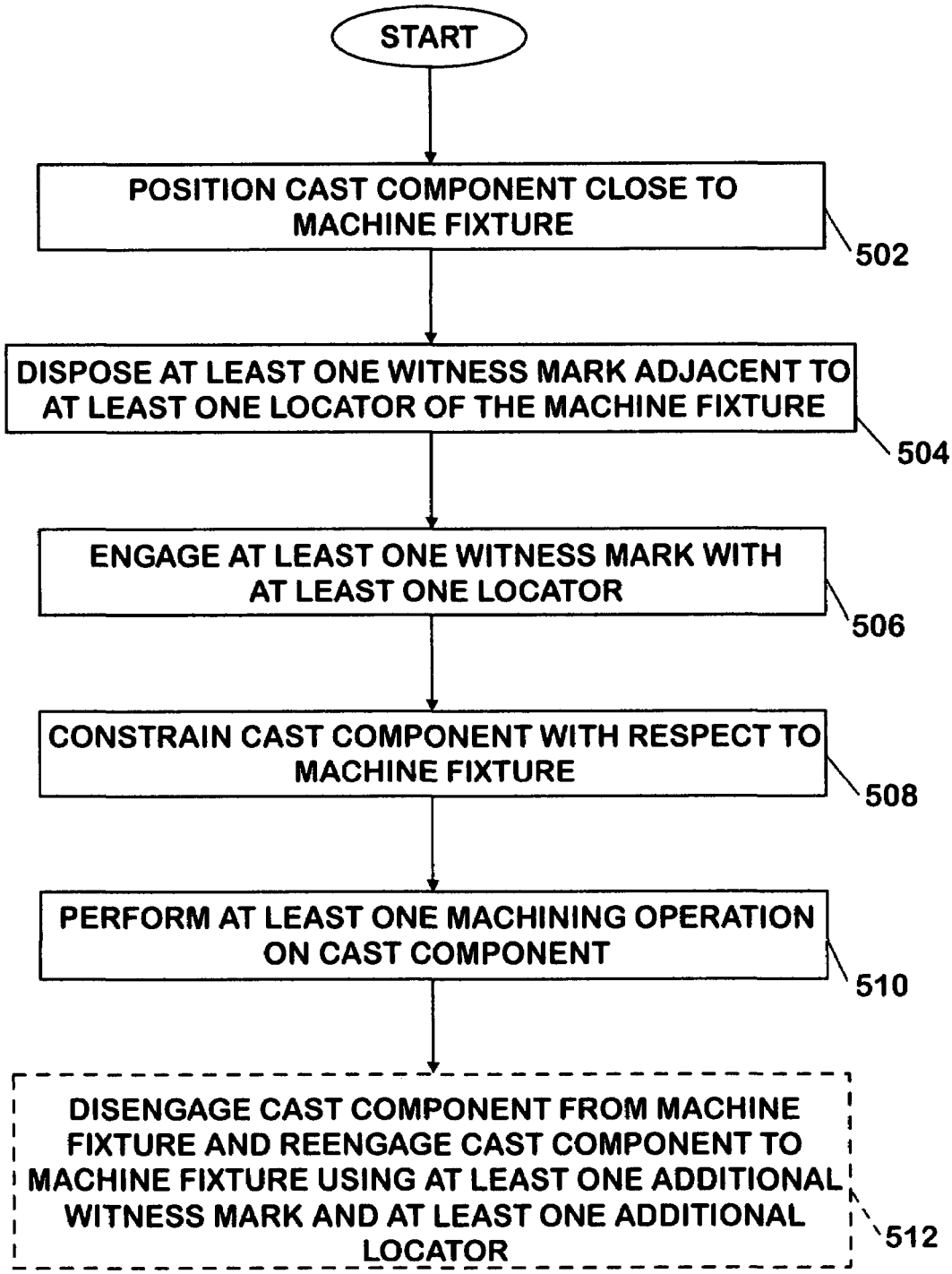
FIG. 5 is a flowchart for a method of machining a crankcase for an internal combustion engine in accordance with the invention.

A flowchart for a method of machining a cast component is shown in FIG. 5. The component may have been formed in a previous casting operation to include witness mark features or openings formed therein. The component may be positioned in the proximity of a machine or fixture at step 502. Some or all of the witness marks on the component may be arranged to be adjacent to some or more locators disposed on the machine at step 504. The component may be put onto the machine at step 506 such that each witness mark engages each corresponding locator. Each witness mark may advantageously constrain the component with respect to the machine with respect to three degrees of freedom at step 508. The machine may perform various machining operations onto the component, for example, planning, grinding, drilling, polishing, and so forth, at step 510. When the machining operations are complete, the component may be optionally repositioned onto the machine using different or the same witness marks that engage different or the same locators at step 512.

Figure 6:
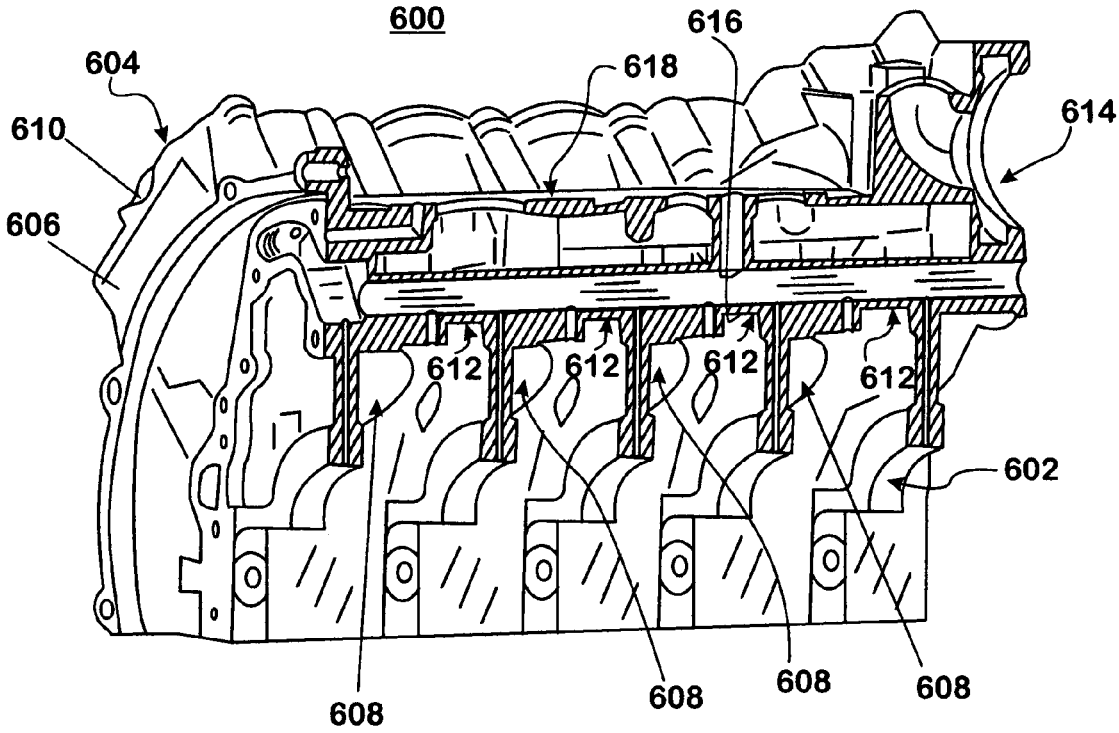
FIG. 6 is a cross section view of an engine crankcase having witness mark machining datums for verification of the relationship between the cylinder head interface surfaces and each of the crank cores.

One embodiment of a complete datum configuration for a crankcase 600 that is capable of locating an orientation and location of a crank core opening 602 is shown in the cross-section view of FIG. 6. The crankcase 600 has a surface 604 on the top of a cylinder bank 606. A plurality of cylinder bore openings 608 that make up the cylinder bank 606 are typically created during a casting operation that forms the crankcase 600. The openings or bores 608 may generally be created when metal flows around a crank core (not shown). It is advantageous to the structure of the crankcase 600 to ensure proper alignment and centering between the surface 604 and each of the bores 608.

A location of the surface 604 with respect to the crankcase 600 may be established through use of a plurality of witness marks 610 (only one of three shown) as described above. More advantageously, a relationship may be established between a plane that is defined by the surface 604 and the crank core, or indirectly, each of the bores 608, by use of a second plurality of core witness marks 612 that are formed into the crankcase 600 by the crank core during the casting operation that forms the crankcase 600. Each of the core witness marks 612 is advantageously located in a valley portion 614 of the crankcase 600, and may be used for positional reference for both banks (only the one bank 606 shown here).

Each of the core witness marks 612 may advantageously have a rectangular shape that includes a bottom surface 616 that should be parallel to a valley surface 618 of the valley portion 614 of the crankcase 600, and that is at a predetermined distance and angle to the surface 604, when the bores 608 are properly aligned. By locating the surface 604 on the left bank 606, a corresponding surface on the right bank (not shown), and a distance to a line defined by the core witness marks 612 when taken together, or a point when considered separately, all cast and machined features of the crankcase 600, along with core location during casting, may advantageously be accomplished.

Figure 7:
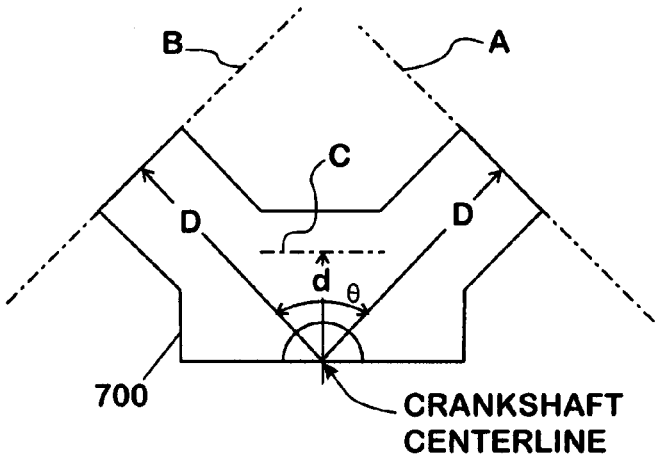
FIG. 7 is a block diagram for a dimensioning scheme for a crankcase in accordance with the invention.

A block diagram for a dimensioning scheme for a crankcase 700 is shown in FIG. 7. The crankcase 700 may have a set of planes or surfaces A and B defined to coincide with each of the cylinder head interface surfaces. The surfaces A and B may be defined with witness marks as described above. As is known, a distance, D, of the surfaces A and B from a crankshaft centerline, and an angle, θ, between the surfaces A and B, are important for the fit, form, and function of the crankcase 700. To facilitate inspection and set-up for machining the crankcase 700, a height, d, may be determined based on a height, C, that is established by the core witness marks between the two banks, as described above. Therefore, the witness marks that establish the surfaces A and B, as well as the core witness marks that establish the height C, may advantageously adequately define important dimensional parameters of the crankcase 700.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A component for an internal combustion engine, comprising:

a plurality of as-cast features formed thereon;

a plurality of machined features;

at least one witness mark, comprising:

a cavity surrounded by a first lateral surface, a first inclined surface, a second inclined surface, and a valley surface;

wherein the at least one witness mark is formed during a casting operation, wherein the witness mark is used to locate the component on a fixture, wherein the plurality of machined features do not encroach onto an area of the at least one witness mark, and wherein the first inclined surface and the second inclined surface are at an angle.

2. The component of claim 1, wherein the angle between the first inclined surface and the second inclined surface is about 90 degrees.

3. The component of claim 1, wherein the at least one witness mark is arranged to engage a locator disposed on the fixture, wherein the locator includes a first beveled surface, a second beveled surface, and a tip, and wherein the first and second beveled surfaces touch the first and second inclined surfaces when the component is disposed on the fixture.

4. The component of claim 1, wherein the component is a crankcase for an internal combustion engine, and wherein the plurality of machined features includes a flat cylinder head interface surface.

5. The component of claim 4, further comprising a second witness mark and a third witness mark, wherein the at least one witness mark, the second witness mark, and the third witness mark are disposed adjacent to an edge of the flat cylinder head interface surface, and wherein each of the at least one witness mark, the second witness mark, and the third witness mark is disposed at a different orientation with another.

6. The component of claim 1, wherein at least some of the as-cast features that are formed thereon are formed using a core for a casting operation, and wherein the component further comprises a plurality of core witness marks that are formed by the core during the casting operation.

7. A crankcase for an internal combustion engine, comprising:

a plurality of cylinder bores arranged in a first bank, wherein the first bank has a first cylinder head interface surface on one end;

a first witness mark and a second witness mark disposed at distal ends and adjacent to an edge of the first cylinder head interface surface;

a third witness mark disposed adjacent to the edge of the first cylinder head interface surface, wherein the third witness mark is rotated with respect to the first and second witness marks;

wherein each of the first, second, and third witness mark includes:

a cavity surrounded on four sides by a first lateral surface, a first inclined surface, a second inclined surface disposed at an internal angle with the first inclined surface, and a valley surface;

wherein each of the first, second, and third witness mark is capable of constraining the crankcase onto a fixture in a first axial direction, a second axial direction, and a first rotational direction.

8. The crankcase of claim 7, wherein the internal angle is 90 degrees, wherein the first axial direction is perpendicular to the second axial direction, and wherein the first rotational direction is about a third axis that is perpendicular to each of the first axial direction and the second axial direction.

9. The crankcase of claim 7, further comprising:

a second bank, wherein the second bank is at an angle with the first cylinder bank, and wherein the second bank has a second cylinder head interface surface on one end;

an additional first witness mark and an additional second witness mark disposed at distal ends and adjacent to an edge of the second cylinder head interface surface;

an additional third witness mark disposed adjacent to the edge of the second cylinder head interface surface, wherein the additional third witness mark is rotated with respect to the additional first and additional second witness marks;

wherein each of the additional first, second, and third witness mark includes:

an additional cavity surrounded on four sides by an additional first lateral surface, an additional first inclined surface, an additional second inclined surface disposed at an internal angle with the additional first inclined surface, and an additional valley surface;

wherein each of the additional first, second, and third witness mark is capable of constraining the crankcase onto a fixture in an additional first axial direction, an additional second axial direction, and an additional first rotational direction.

10. The crankcase of claim 7, further comprising a plurality of core witness marks, wherein the core witness marks are formed by a crank core that forms the plurality of cylinder bores during a casting operation.

* * * * *